US008453402B2

(12) United States Patent
Huang

(10) Patent No.: US 8,453,402 B2
(45) Date of Patent: Jun. 4, 2013

(54) FRAME UNIT OF A CURTAIN WALL

(76) Inventor: Rong-Jun Huang, Taichung (TW)

( * ) Notice: Subject to any disclaimer, the term of this patent is extended or adjusted under 35 U.S.C. 154(b) by 16 days.

(21) Appl. No.: 13/097,472

(22) Filed: Apr. 29, 2011

(65) Prior Publication Data

US 2012/0272605 A1 Nov. 1, 2012

(51) Int. Cl.
*E04H 14/00* (2006.01)

(52) U.S. Cl.
USPC ..... 52/235; 52/653.2; 52/655.1; 52/656.5; 52/656.9

(58) Field of Classification Search
USPC ..... 52/235, 653.2, 655.1, 656.1, 656.5, 52/656.9
See application file for complete search history.

(56) References Cited

U.S. PATENT DOCUMENTS

| | | | | |
|---|---|---|---|---|
| 3,265,416 | A * | 8/1966 | Downes | 403/264 |
| 3,513,606 | A * | 5/1970 | Jones | 52/27 |
| 3,612,585 | A * | 10/1971 | Mayr | 403/264 |
| 3,867,048 | A * | 2/1975 | Endzweig | 403/252 |
| 3,901,612 | A * | 8/1975 | Canin | 403/189 |
| 4,977,717 | A * | 12/1990 | Niwata | 52/235 |
| 5,481,842 | A * | 1/1996 | Gautreau | 52/656.9 |
| 5,729,948 | A * | 3/1998 | Levy et al. | 52/656.9 |
| 5,746,535 | A * | 5/1998 | Kohler | 403/258 |
| 6,331,092 | B1 * | 12/2001 | Linger | 403/382 |
| 6,481,177 | B1 * | 11/2002 | Wood | 52/656.9 |
| 6,712,540 | B2 * | 3/2004 | Schmalzhofer et al. | 403/248 |
| 6,712,543 | B1 * | 3/2004 | Schmalzhofer | 403/381 |
| 7,004,667 | B2 * | 2/2006 | Ludwig et al. | 403/258 |
| 7,162,842 | B2 * | 1/2007 | Ribic | 52/235 |
| 7,823,346 | B2 * | 11/2010 | Lang | 52/235 |
| 8,100,600 | B2 * | 1/2012 | Blum | 403/256 |
| 2004/0025459 | A1 * | 2/2004 | Huebner et al. | 52/282.1 |
| 2004/0079038 | A1 * | 4/2004 | Crooker, Jr. | 52/235 |

FOREIGN PATENT DOCUMENTS

FR 2705710 A3 * 12/1994

* cited by examiner

*Primary Examiner* — Joshua J Michener
*Assistant Examiner* — Matthew Gitlin
(74) *Attorney, Agent, or Firm* — patenttm.us

(57) ABSTRACT

A frame unit of a curtain wall has a mullion, a beam and a connecting device. The mullion has a mullion recess and a mullion channel. The beam is substantially the same as the mullion and has a beam recess and a beam channel. The connecting device has a first group and a second group. The first group has a plate, two chunks and two bolts. The plate is mounted in the mullion recess. The chunks are mounted in the mullion channel. The bolts are mounted through the plate and are respectively screwed into the chunks. The second group is the same as the first group and is similarly connected with the beam. Because one beam can be connected with and spreads forces to multiple mullions, a structure of a curtain wall can be enhanced.

10 Claims, 14 Drawing Sheets

FRAME UNIT OF A CURTAIN WALL

BACKGROUND OF THE INVENTION

1. Field of the Invention

The present invention relates to a frame unit, and more particularly to a frame unit of a curtain wall to enhance the structural strength of the curtain wall.

2. Description of Related Art

With reference to FIG. 13, a conventional frame unit 90 of a curtain wall has one beam 91 and one mullion 92. Two opposite sides of the mullion 92 are respectively connected with the beam 91 and a beam 91 of another frame unit 90. With reference to FIG. 14, another conventional frame unit R of a curtain wall has a beam R1 and a mullion R2 with which an end of the beam R1 is securely connected. Multiple frame units R can be assembled with multiple plates of glass to form a curtain wall.

However, the beam 91,R1 of the conventional frame unit 90,R has to be mounted between and connected with two mullions 92,R2, and two ends of one beam 91,R1 cannot be connected with more than two mullions 92,R2. The curtain wall cannot bear strong wind loads because one beam 91,R1 cannot quickly spread the wind loads to more than two mullions 92,R2.

The thickness and width of the conventional mullions 92,R2 have to be enlarged to bear the wind loads, but this will increase the costs for material and manufacture of the mullions 92,R2.

Additionally, the structure of the conventional frame unit is complicated and the assembling of the conventional frame units is inconvenient and time consumptive.

To overcome the shortcomings, the present invention tends to provide a frame unit of a curtain wall to mitigate the aforementioned problems.

SUMMARY OF THE INVENTION

The main objective of the invention is to provide a frame unit of a curtain wall to enhance the structural strength of the curtain wall.

A frame unit of a curtain wall has a mullion, a beam and a connecting device. The mullion has a mullion recess and a mullion channel. The beam is substantially the same as the mullion and has a beam recess and a beam channel. The connecting device has a first group and a second group. The first group has a plate, two chunks and two bolts. The plate is mounted in the mullion recess. The chunks are mounted in the mullion channel. The bolts are mounted through the plate and are respectively screwed into the chunks. The second group is the same as the first group and is similarly connected with the beam. Because one beam can be connected with and spreads forces to multiple mullions, a structure of a curtain wall can be enhanced.

Other objects, advantages and novel features of the invention will become more apparent from the following detailed description when taken in conjunction with the accompanying drawings.

DETAILED DESCRIPTION OF PREFERRED EMBODIMENT

Figure 1:
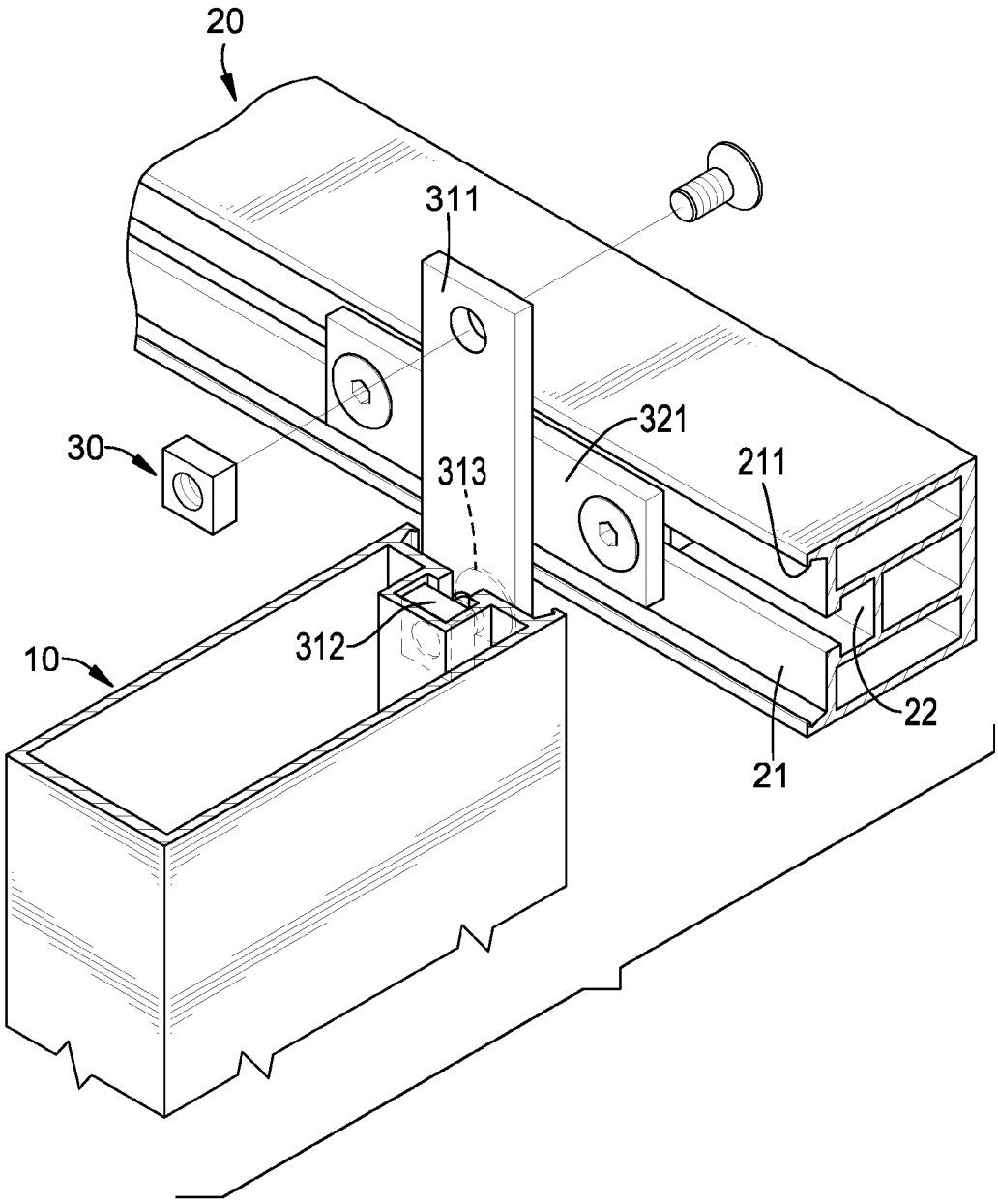
FIG. 1 is an exploded view in partial section of a first embodiment of a frame unit of a curtain wall in accordance with the present invention.
Figure 2:
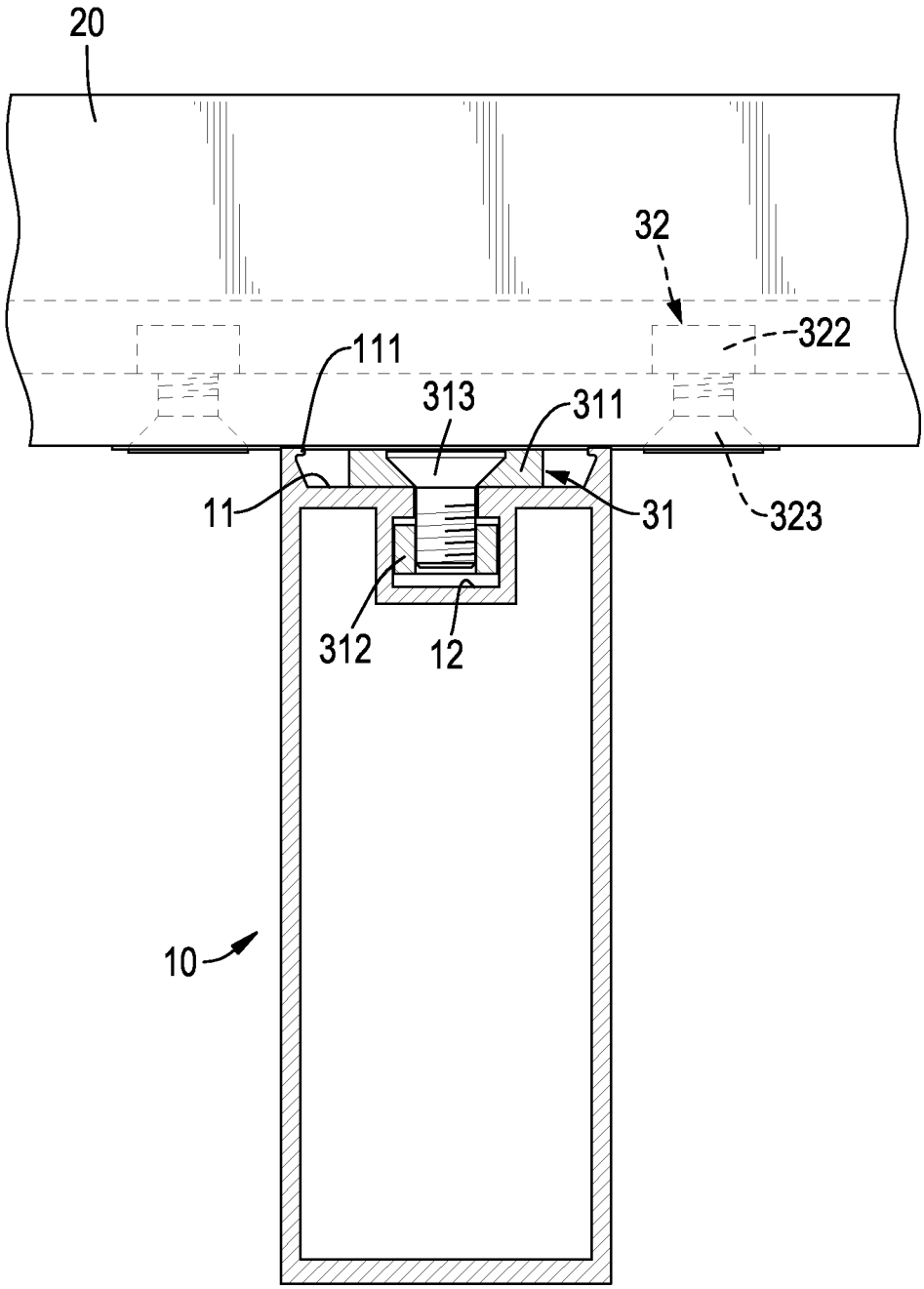
FIG. 2 is a top view in partial section of the frame unit of a curtain wall in FIG. 1.
Figure 3:
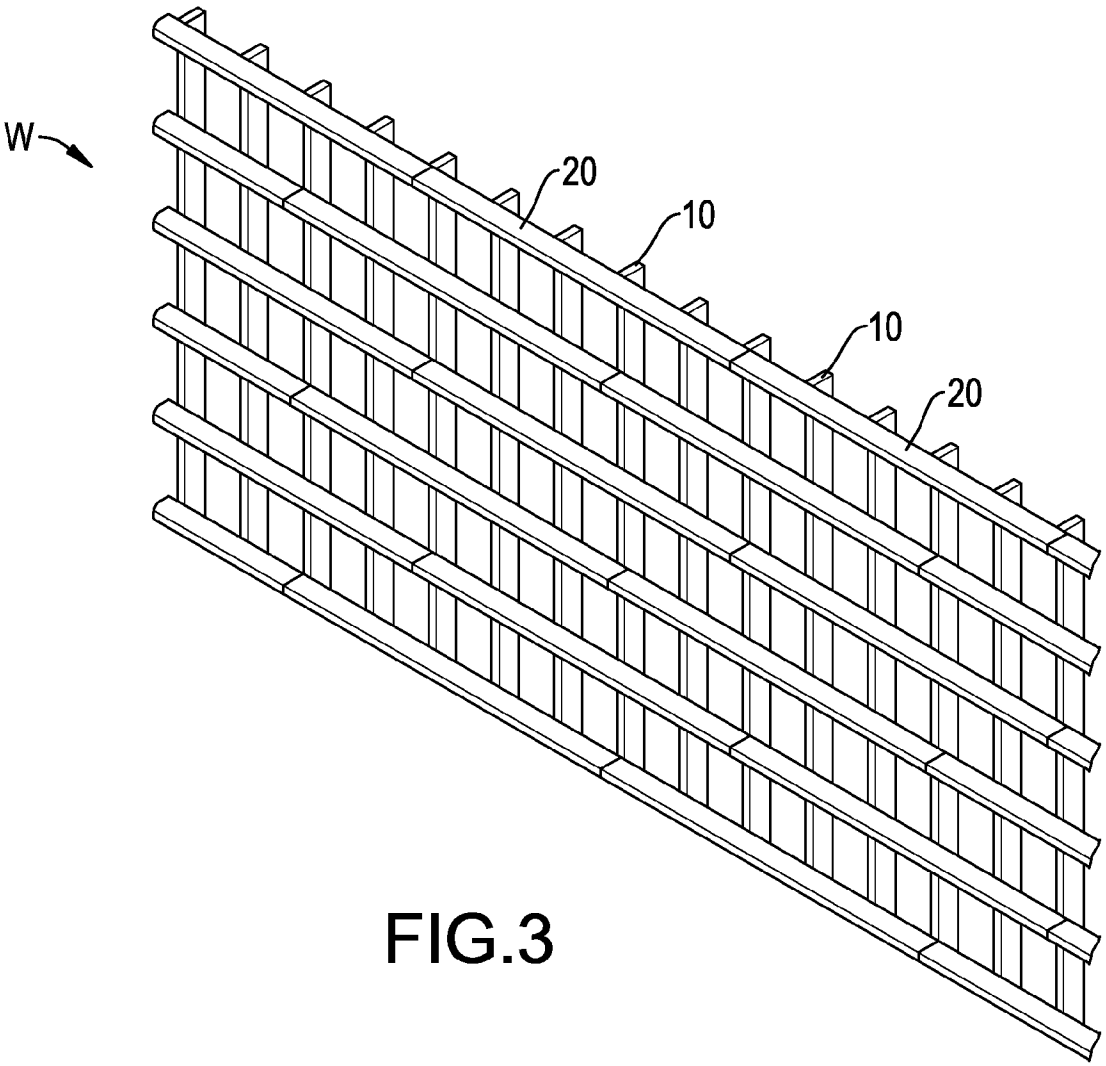
FIG. 3 is a perspective view of a first embodiment of a curtain wall implemented by multiple frame units in FIG. 1.

With reference to FIGS. 1 to 3, a first embodiment of a frame unit of a curtain wall in accordance with the present invention comprises a mullion 10, a beam 20 and a connecting device 30.

The mullion 10 is an elongated member and has a top surface, a bottom surface, a side surface, a linear mullion recess 11 and a linear mullion channel 12.

The mullion recess 11 is formed in the side surface of the mullion 10, is formed through the top surface and the bottom surface of the mullion 10 and has an opening, two opposite inner surfaces, a bottom, two clamping sections 111 and an extending length.

The bottom of the mullion recess 11 has a width. The opening of the mullion recess 11 has a width and two opposite edges. Preferably, the width of the opening of the mullion recess 11 is larger than that of the bottom of the mullion recess 11. Each inner surface of the mullion 10 leans from the bottom of the mullion recess 11 to the opening of the mullion recess 11.

The clamping sections 111 are respectively formed along the edges of the opening of the mullion recess 11. Each of the clamping sections 111 extends longitudinally and has an inner surface and an extending length the same as that of the mullion recess 11.

The mullion channel 12 is formed in the bottom of the mullion recess 11 and has an extending length the same as that of the mullion recess 11. The mullion channel 12 has a rectangular cross section.

The beam 20 is an elongated member, abuts the mullion 10 and has two opposite end surfaces, a side surface, a linear beam recess 21 and a linear beam channel 22.

The beam recess 21 is formed in the side surface of the beam 20, is formed through the end surfaces of the beam 20 and has a bottom and an extending length. The bottom of the beam recess 21 has a width. Preferably, the beam recess 21 has an opening, two opposite inner surfaces and two clamping sections 211. The opening of the beam recess 21 has a width, an upper edge and a lower edge. The width of the opening of the beam 20 is larger than that of the bottom of the beam recess 21. The lower edge of the beam 20 is opposite to the upper edge of the opening of the beam recess 21. Each inner surface of the beam 20 leans from the bottom of the beam recess 21 to the opening of the beam recess 21.

The clamping sections 211 are respectively formed along the upper edge and the lower edge of the opening of the beam recess 21. Each of the clamping sections 211 extends latitudinally and has an inner surface and an extending length the same as that of the beam recess 21.

The beam channel 22 is formed in the bottom of the beam recess 21 and has an extending length the same as that of the beam recess 21. The beam channel 22 has a rectangular cross section.

With reference to FIGS. 1 and 2, the connecting device 30 is securely connected with the mullion 10 and the beam 20 and has a first group 31 and a second group 32.

The first group 31 is connected with the mullion 10 and has a plate 311, two chunks 312 and two bolts 313. The plate 311 is mounted in the mullion recess 11. The chunks 312 are mounted in the mullion channel 12. The bolts 313 are mounted through the plate 311 and are respectively screwed into the chunks 312.

A structure of the second group 32 may be the same as that of the first group 31. The second group 32 is mounted in the beam recess 21 and the beam channel 22 and has a plate 321, two chunks 322 and two bolts 323. The plate 321 of the second group 32 is connected securely with the plate 311 of the first group 31. Preferably, the plates 311,321 of the first group 31 and the second group 32 are formed as a cross.

Preferably, a thickness of the plate 311 of the first group 31 is smaller than a depth of the mullion recess 11, and a thickness of the plate 321 of the second group 32 is smaller than a depth of the beam recess 21. Accordingly, the mullion recess 11 and the beam recess 21 can completely encompass the plates 311,321 to enable the mullion 10 to abut the beam 20. The thicknesses of the plates 311,321 may respectively be equal to the depths of the mullion recess 11 and the beam recess 21. The present invention does not limit the thicknesses of the plates 311,321.

With reference to FIG. 3, multiple mullions 10, beams 20 and connecting devices 30 are implemented and assembled as a first embodiment of a curtain wall W. FIG. 3 refers to the arrangement of the multiple frame units in FIG. 1, but the detailed appearance of the frame unit in FIG. 1 is not explicitly shown. FIG. 3 merely shows how the beams 20 are arranged.

Figure 4:
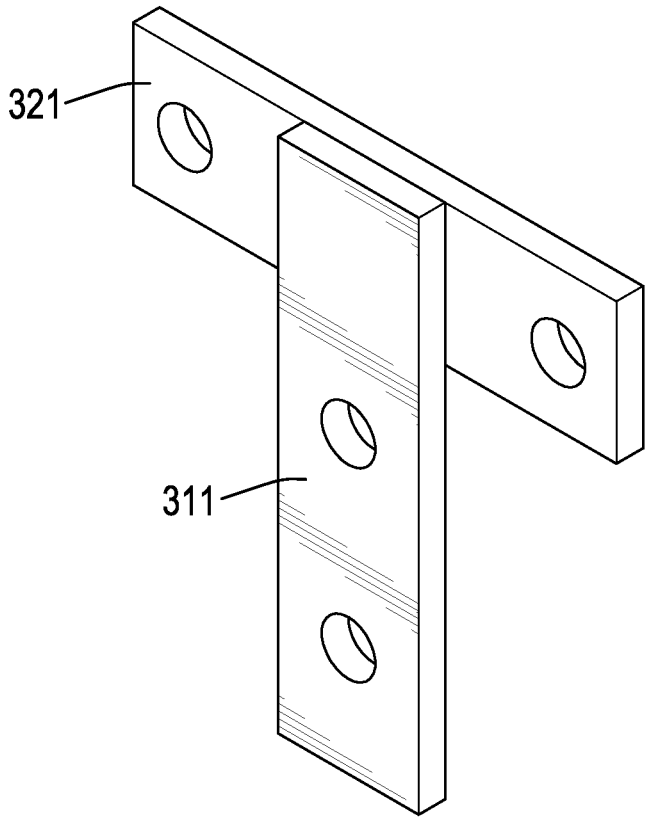
FIG. 4 is an enlarged perspective view of plates of the frame unit in FIG. 1 to be formed into a T shape.

A process of assembling the mullions 10, the beams 20 and the connecting devices 30 are as follows. First, multiple plates 311 of the first groups 31 are securely held in the mullion recesses 11 of the mullion 10 by the bolts 313. The plate 311 of the first group 31 and the plate 321 of the second group 32 that is adjacent to a top of each mullion 10 are formed into a T shape, as shown in FIG. 4. Accordingly, the plates 321 of the second groups 32 do not protrude out from the top of the curtain wall W.

Second, the plates 321 and the chunks 322 of the second groups 32 are put respectively into the beam recesses 21 and the beam channels 22 and are secured by the bolts 323. Ends of any longitudinally adjacent two of the beams 20 are misaligned from each other to enhance the structural strength of the curtain wall W.

Finally, multiple plates of glass are mounted securely on the spaces defined by and between the beams 20 and the mullions 10 by silicone adhesives.

Figure 5:
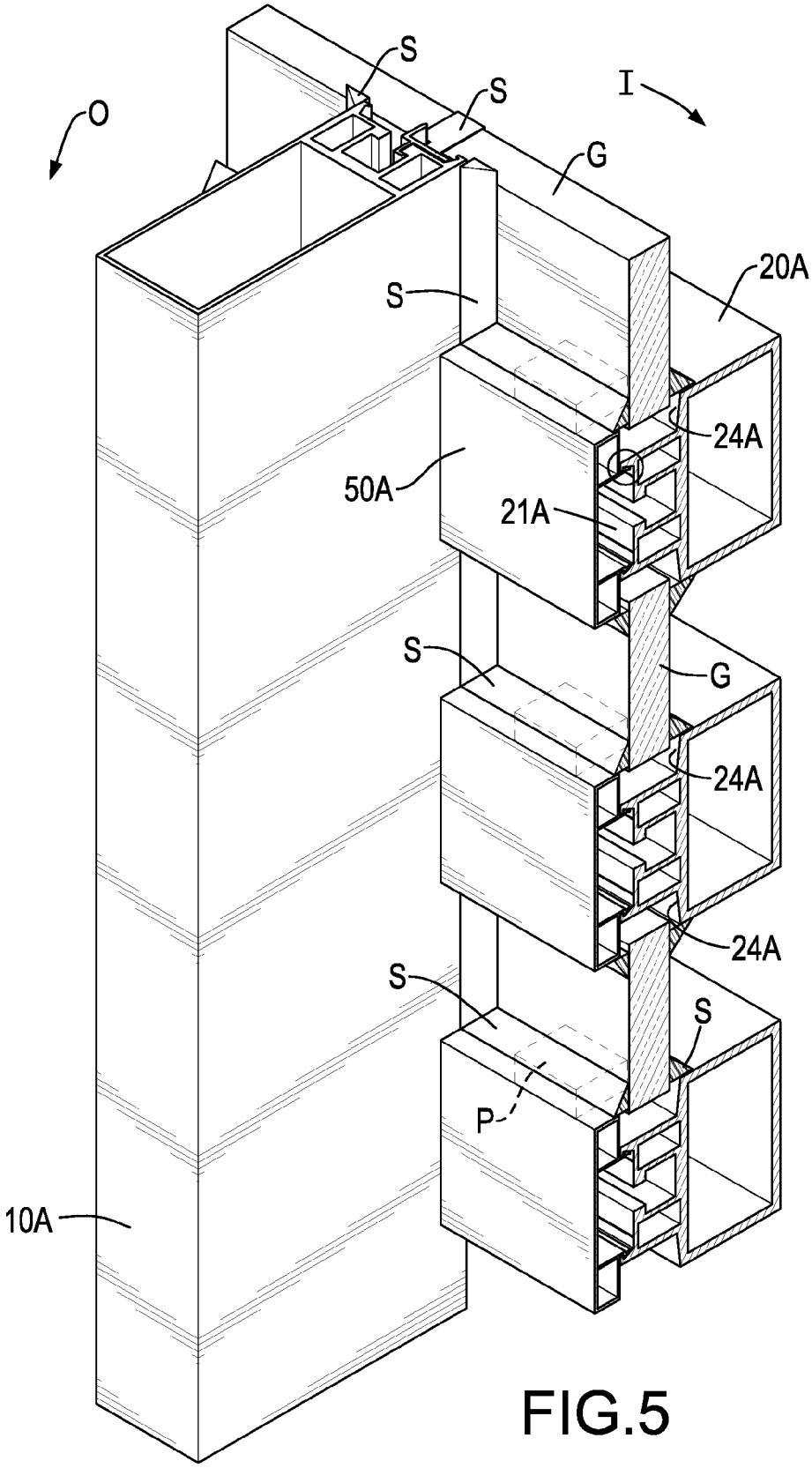
FIG. 5 is a perspective view in partial section of a second embodiment of frame units of a curtain wall in accordance with the present invention.
Figure 6:
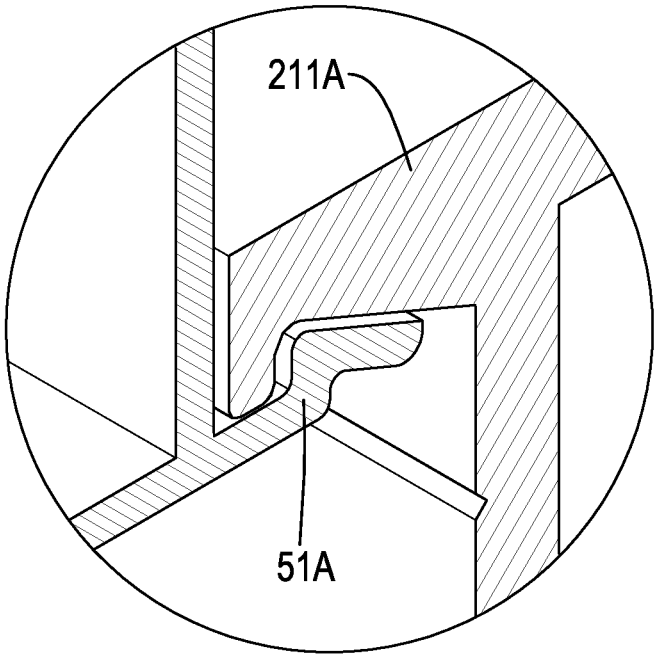
FIG. 6 is an enlarged perspective view in partial section of the second embodiment of the frame unit of a curtain wall in FIG. 5.

With reference to FIGS. 5 and 6, a second embodiment of the frame unit of a curtain wall is substantially the same as the first embodiment except for the following features.

The beam 20A has a top surface, a bottom surface and two glass recesses 24A. The glass recesses 24A are respectively formed in the top surface and the bottom surface of the beam 20A. Each of the glass recesses 24A extends latitudinally and has an extending length the same as that of the beam recess 21A. Accordingly, a top and a bottom of glass G can respectively be mounted in two corresponding glass recesses 24A and be positioned by the beam 20A and a beam cover 50A. Preferably, a hexahedral glass pad P is mounted in each of the glass recesses 24A. A top and a bottom of each glass pad P respectively abut the bottom of a corresponding glass G and a bottom of a corresponding glass recess 24A. Therefore, the plates of glass G can be supported by the glass pads P.

Silicone adhesives are applied to and seal the gaps between the plates of glass G, the mullions 10A and the beams 20A to form multiple adhesive strips S for securing the plates of glass G.

A left area in FIG. 5 is defined as an exterior O of the curtain wall and a right area in FIG. 5 is defined as an interior I of the curtain wall. The mullions 10A are located in the exterior O of the curtain wall, and sides of the beams 20A that face the exterior O of the curtain wall are covered by multiple beam covers 50A.

With further reference to FIG. 6, each beam cover 50A has two opposite end surfaces, a side surface and two clipping sections 51A. The clipping sections 51A are formed on the side surface of the beam cover 50A and respectively abut the inner surfaces of the clamping sections 211A. Accordingly, the beam covers 50A can cover the sides of the beams 20A that face the exterior O of the curtain wall. The mullions 10A are invisible from the interior I of the curtain wall.

Figure 7:
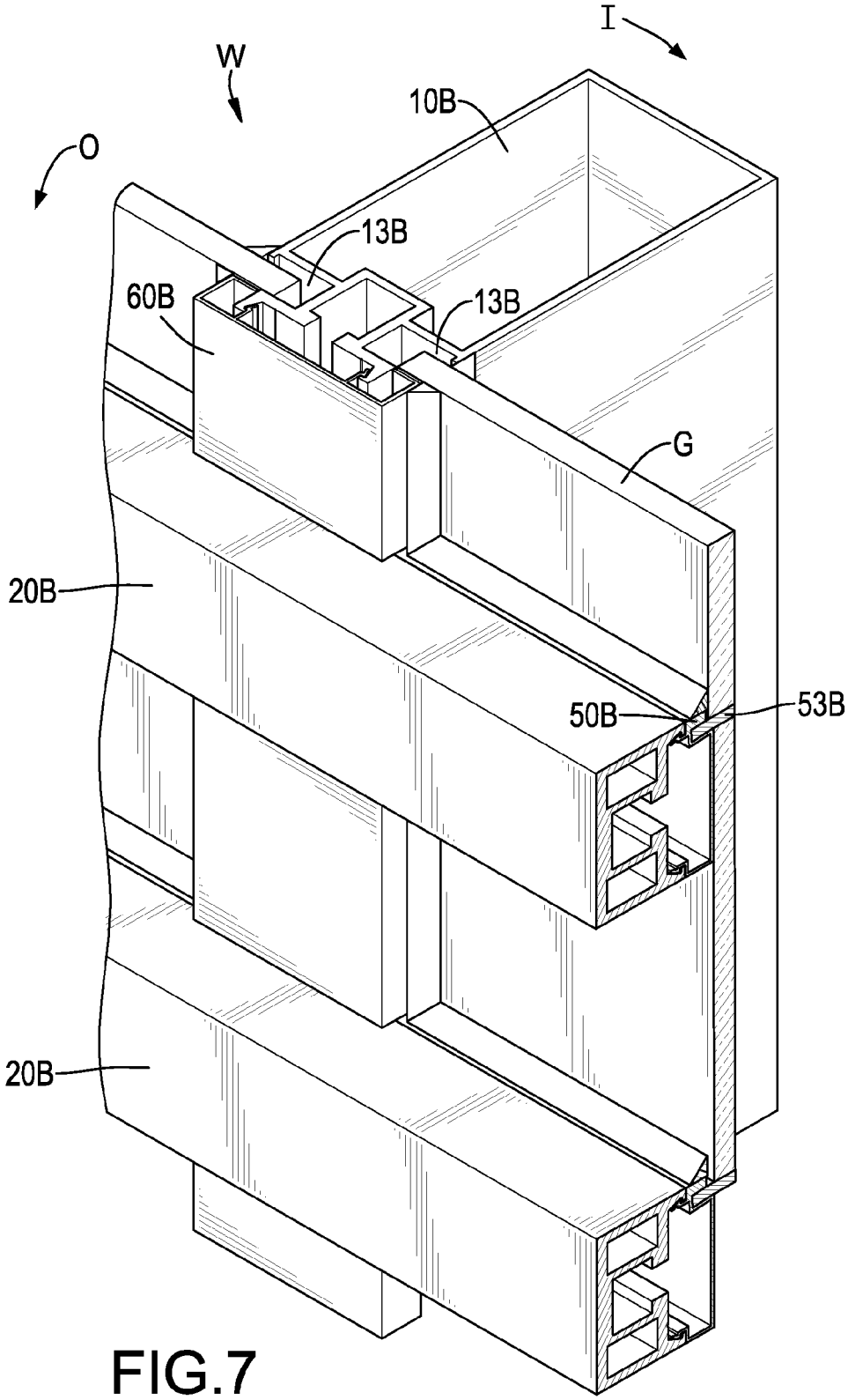
FIG. 7 is a perspective view in partial section of a third embodiment of frame units of a curtain wall in accordance with the present invention.

With reference to FIG. 7, a third embodiment of the frame unit of a curtain wall is substantially the same as the second embodiment except for the following features.

Each mullion 10B has two sides and two glass recesses 13B respectively formed in the sides of the mullion 10B. A left area in FIG. 7 is defined as an exterior O of a curtain wall W and an right area in FIG. 7 is defined as an interior I of the curtain wall W. The mullions 10B are located at the interior I of the curtain wall W, and sides of the mullions 10B that face the exterior O of the curtain wall W are covered by multiple mullion covers 60B.

A glass support 53B is mounted on and protrudes out from each beam cover 50B toward the interior I of the curtain wall W. A plate of glass G is mounted between two adjacent glass supports 53B by silicone adhesives. The structure and the function of the beam cover 50B of the third embodiment are substantially the same as those of the beam cover 50A of the second embodiment, so detailed description of the beam covers 50B are omitted. The beam covers 50B can cover the beams 20B. The connection between the mullions 10B and the mullion covers 60B of the third embodiment is the same as the connection between the beams 20A and the beam cover 50A of the second embodiment. Accordingly, the beams 20B of the third embodiment are located at the exterior O of the curtain wall W, and the mullions 10B, instead of the beams 20B, are invisible from the exterior O of the curtain wall W.

Figure 8:
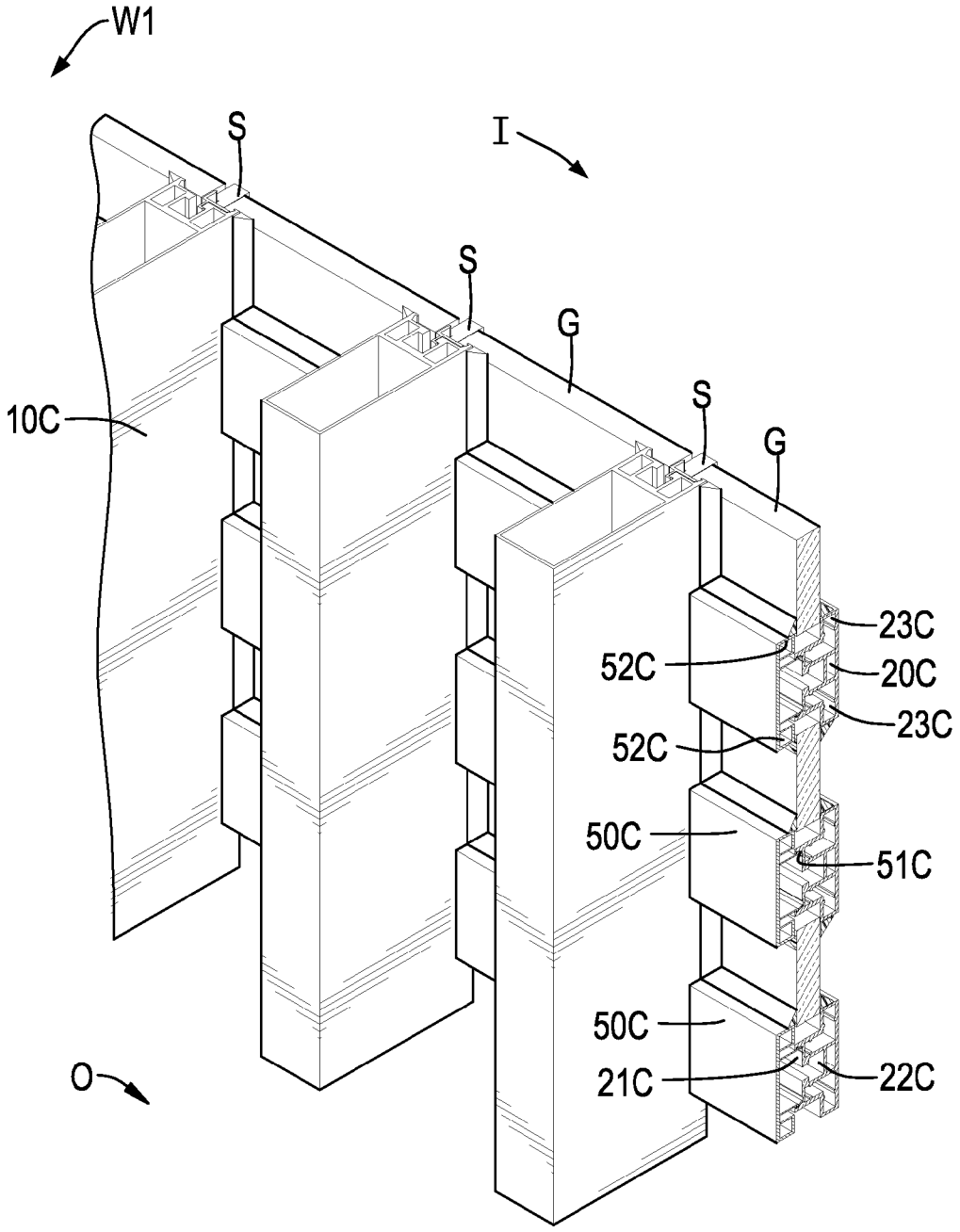
FIG. 8 is a perspective view in partial section of a fourth embodiment of frame units of a curtain wall in accordance with the present invention.

With reference to FIG. 8, a fourth embodiment of the frame unit of a curtain wall is substantially the same as the second embodiment except for the following features.

The beam 20C is hollow and has an inner space. The inner space of the beam 20C has a top, a bottom and two stick recesses 23C. The stick recesses 23C are formed through the end surfaces of the beam 20C and respectively formed in the top and the bottom of the inner space of the beam 20C beside the beam recess 21C and the beam channel 22C. The beam cover 50C is hollow and has an inner space. The inner space of the beam cover 50C has a top, a bottom and two stick recesses 52C. The stick recesses 52C of the beam cover 50C are formed through the end surfaces of the beam cover 50C and formed respectively in the top and the bottom of the inner space of the beam cover 50C beside the clipping sections 51C.

The curtain wall implemented by the fourth embodiment of the frame units is defined as a first curtain wall W1.

Figure 9:
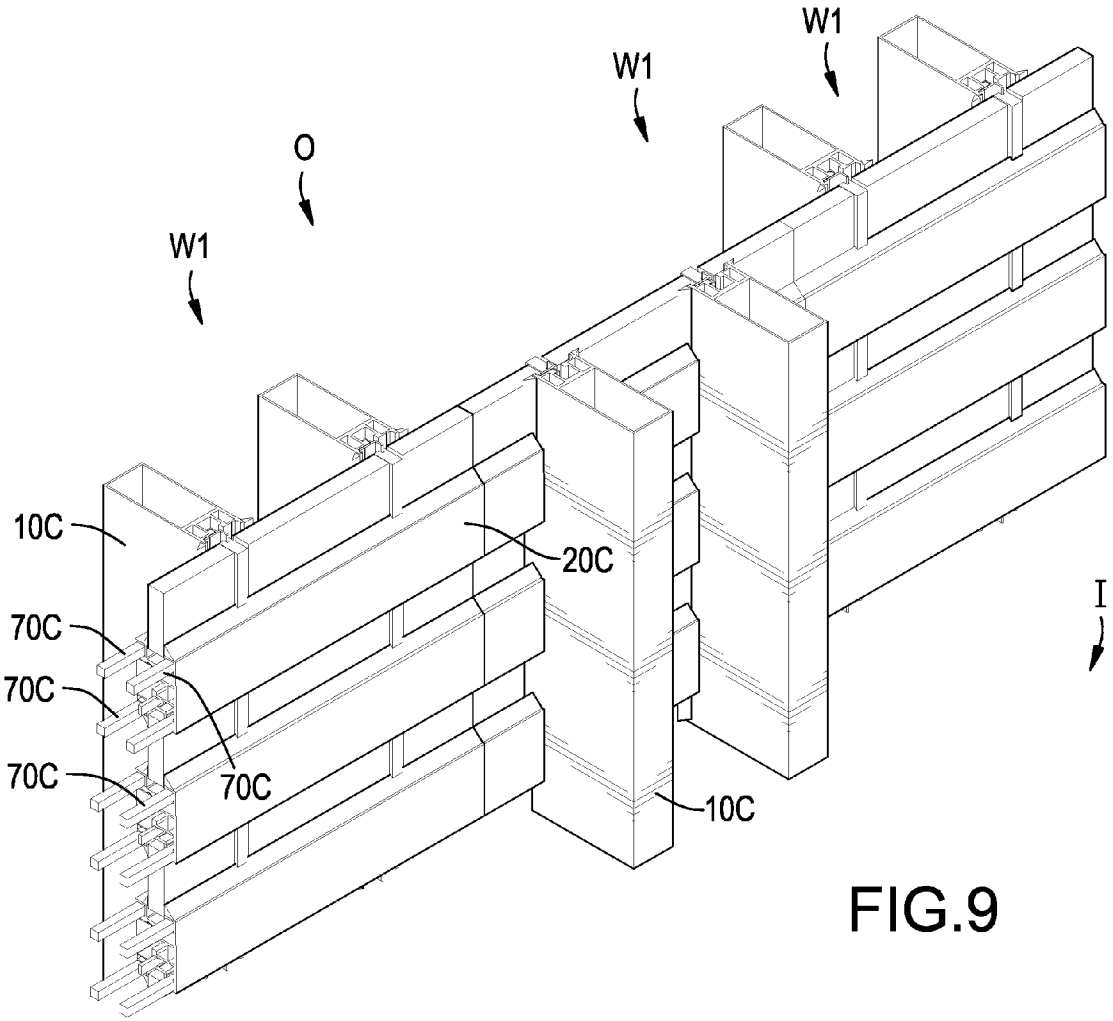
FIG. 9 is a perspective view of a second embodiment of a curtain wall implemented by multiple frame units in FIG. 8.

With further reference to FIG. 9, multiple sticks 70C are respectively inserted into the stick recesses 23C, 52C of the beams 20C and the beam covers 50C. Each stick 70C is linear and has two ends respectively inserted into two adjacent first curtain walls W1. With the sticks 70C, multiple first curtain walls W1 can be connected to form a second embodiment of the curtain wall. Consequently, the mullions 10C may be visible from both the exterior O and the interior I of the connected curtain walls W1.

Figure 10:
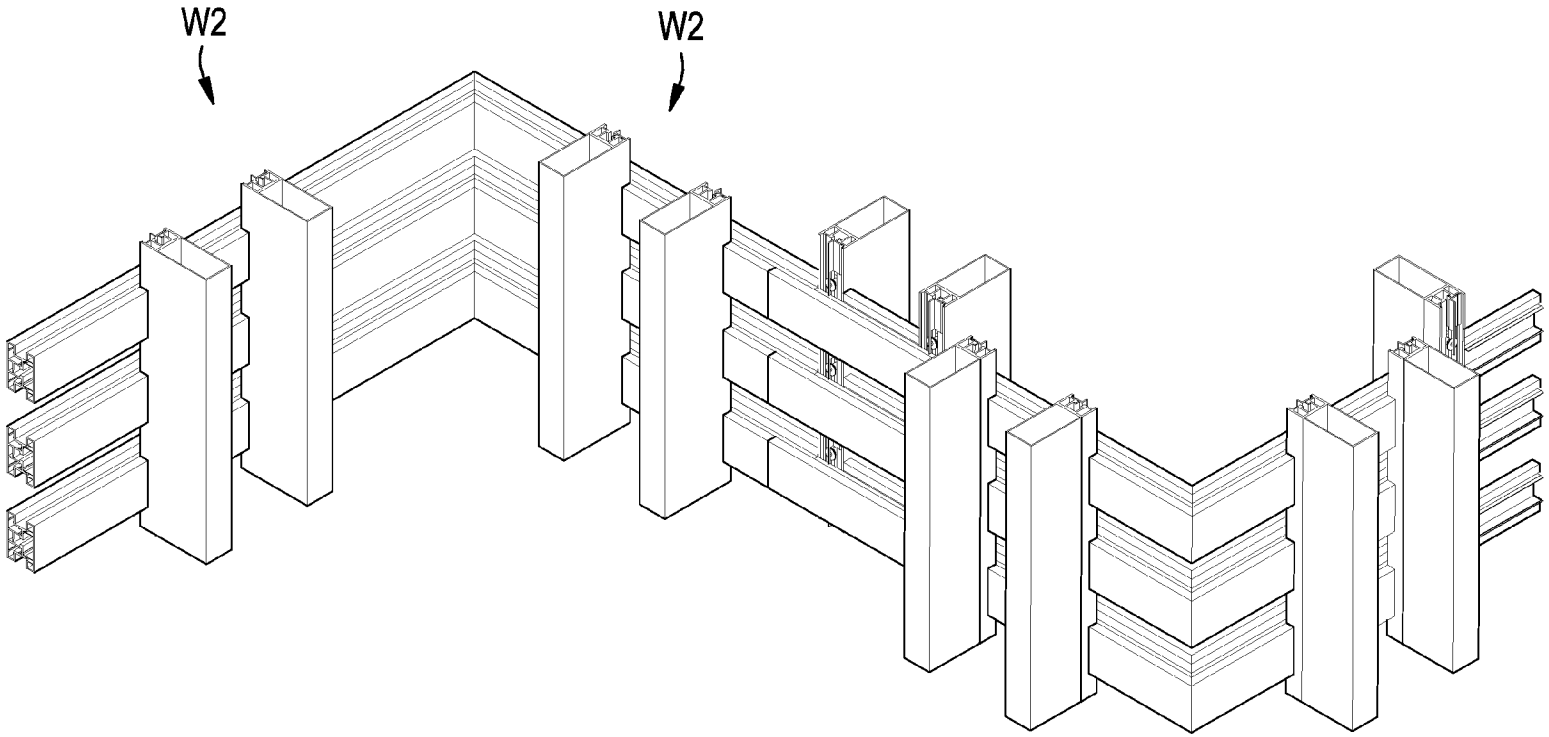
FIG. 10 is a perspective view of a third embodiment of a curtain wall implemented by multiple frame units in FIG. 8.
Figure 11:
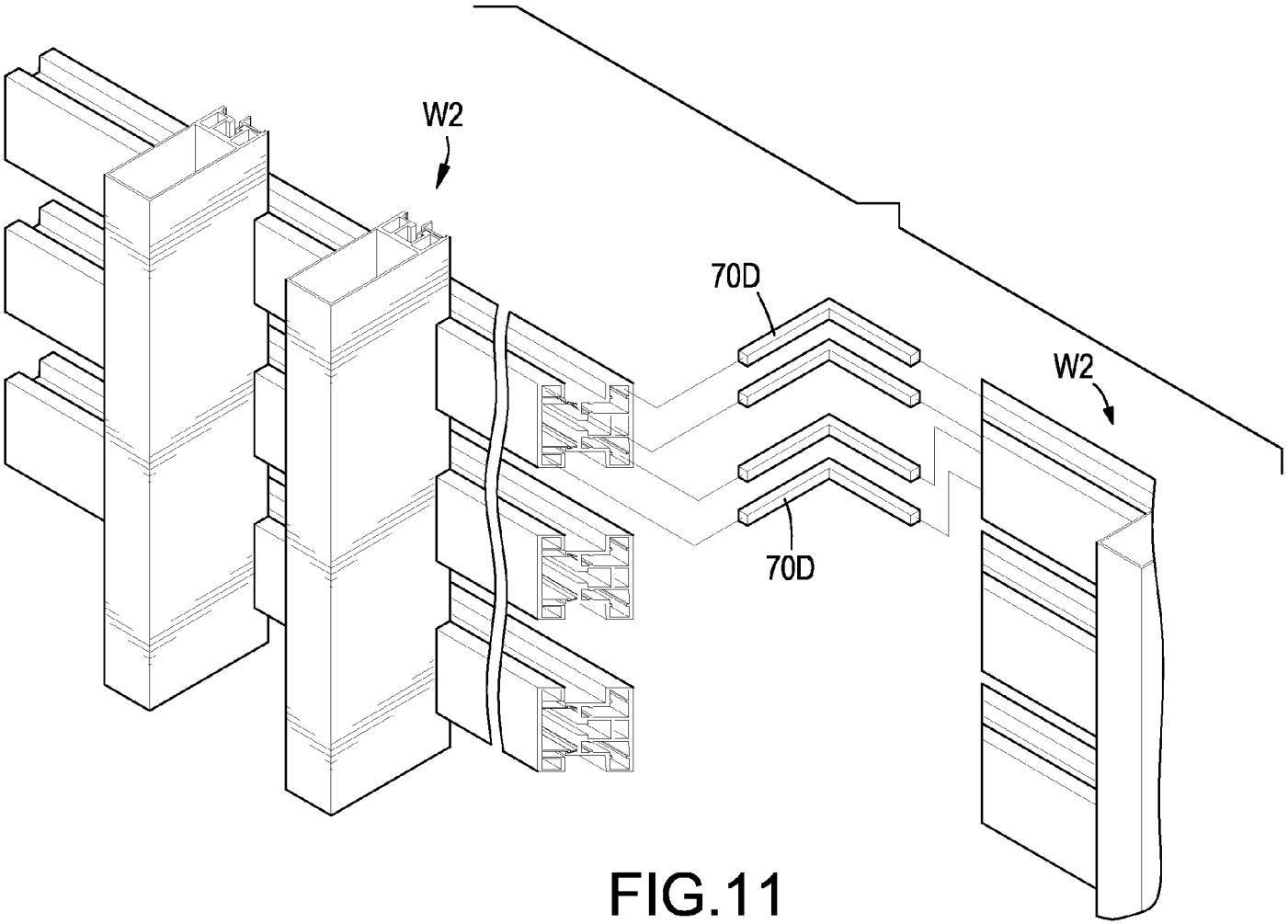
FIG. 11 is an enlarged exploded perspective view of the third embodiment of the curtain wall with multiple frame units in FIG. 10 showing multiple L-shaped sticks.

With reference to FIGS. 10 and 11, a third embodiment of the curtain wall implemented by multiple frame units in FIG. 8 is substantially the same as the second embodiment of the curtain wall except that some of the sticks 70D are L-shaped. The curtain walls in FIGS. 10 and 11 are defined as second curtain walls W2.

The L-shaped sticks 70D connect two adjacent second curtain walls W2 perpendicularly with each other. With the linear and L-shaped sticks 70C,70D, the format of the connected curtain wall is diversified and can be changed in the light of various circumstances.

Figure 12:
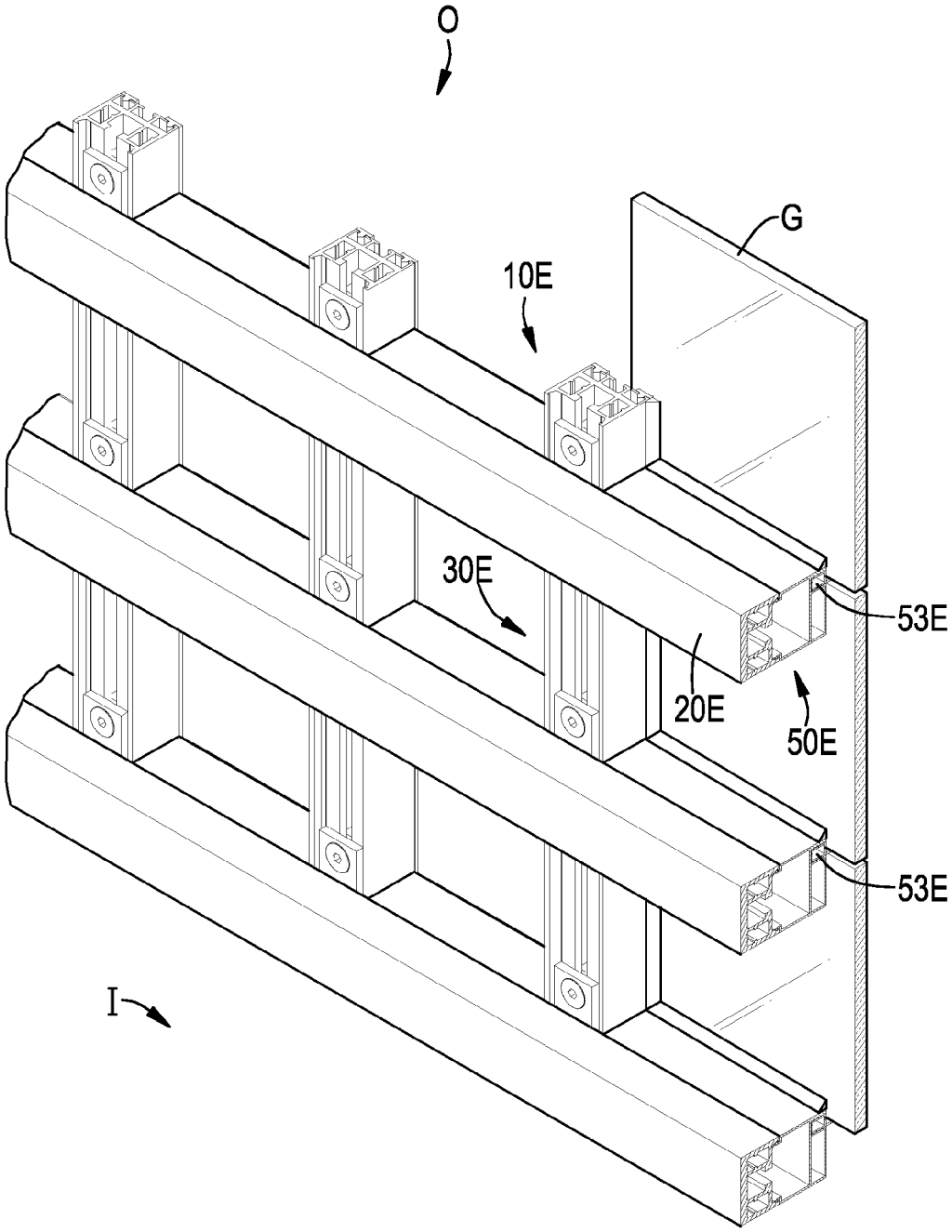
FIG. 12 is a perspective view of a fifth embodiment of frame units of a curtain wall in accordance with the present invention.
Figure 13:
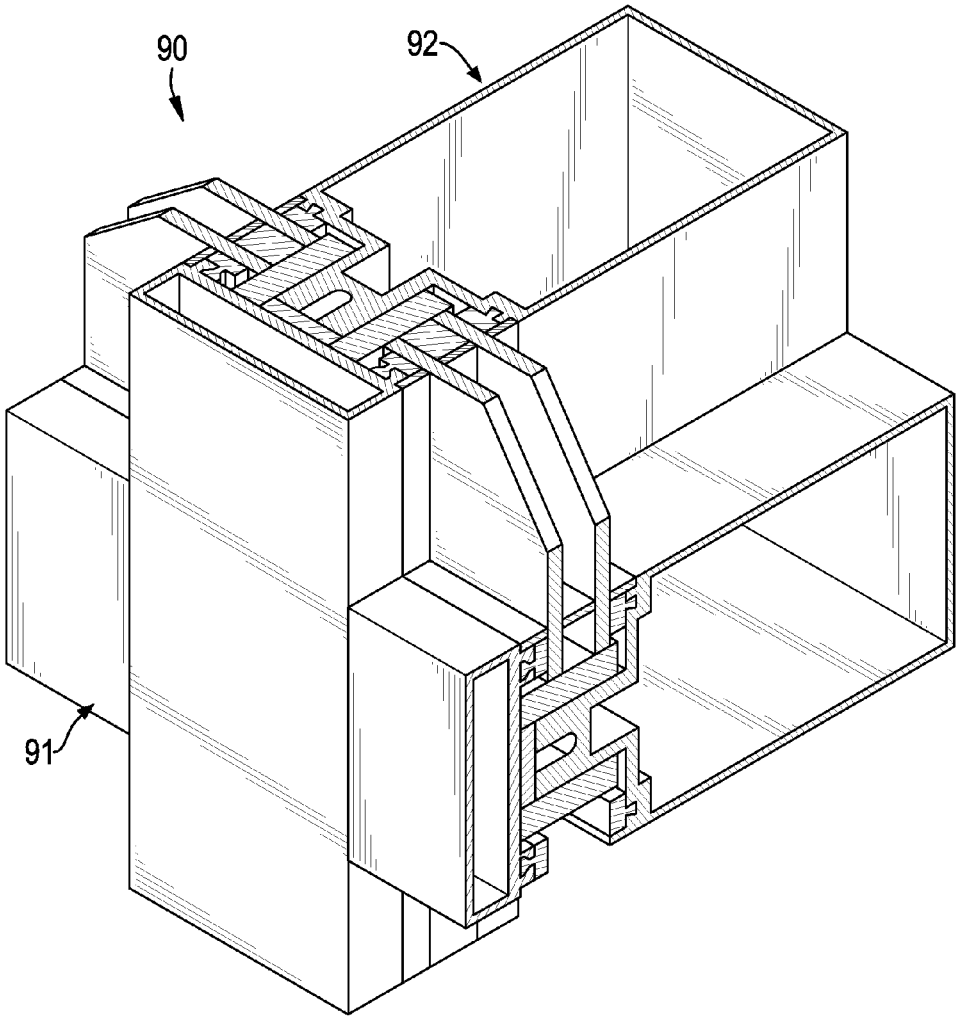
FIG. 13 is an enlarged perspective view in partial section of a conventional frame unit of a curtain wall in accordance with the prior art.
Figure 14:
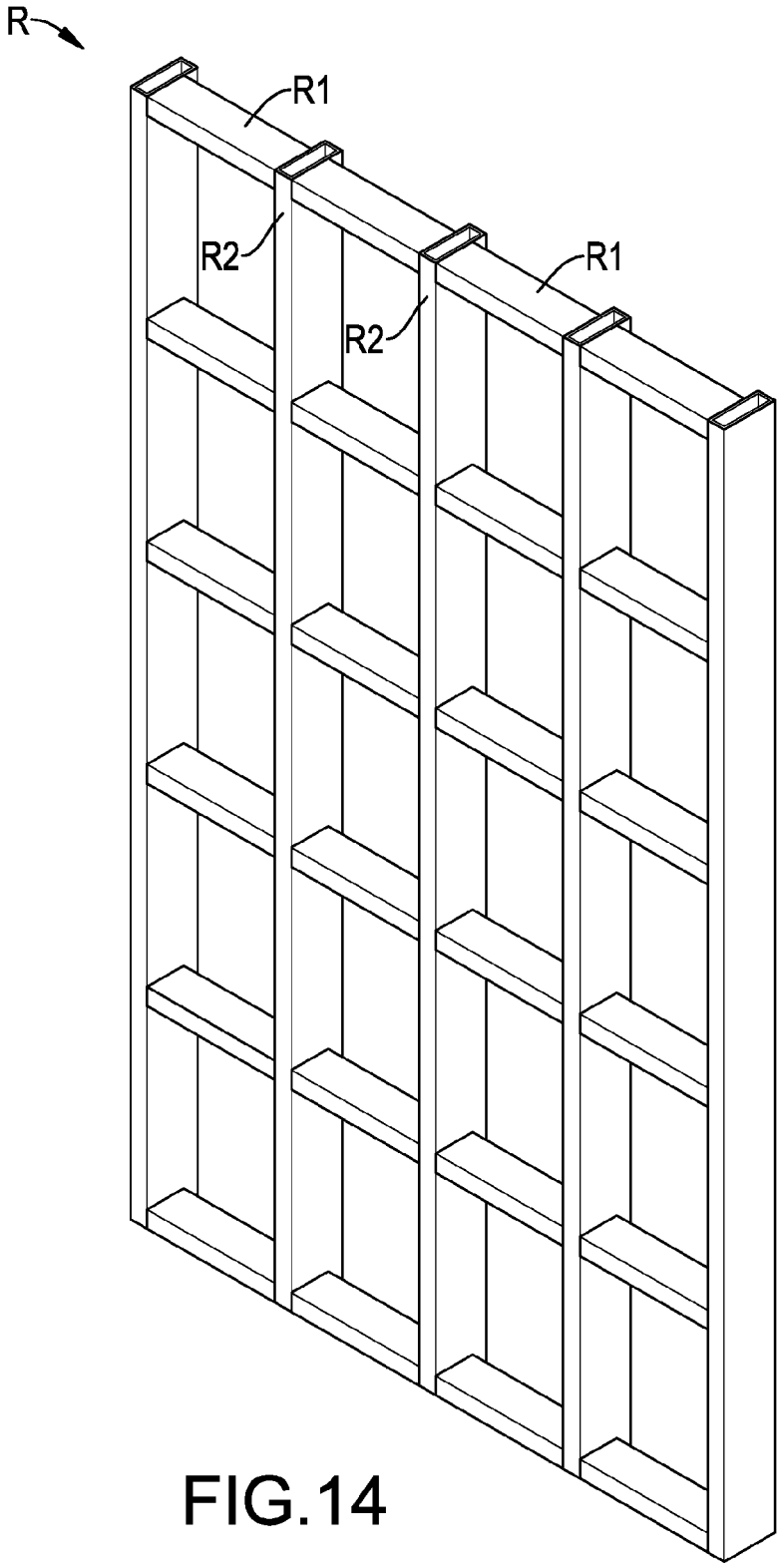
FIG. 14 is a perspective view of a curtain wall implemented by another multiple conventional frame units in accordance with the prior art.

With reference to FIG. 12, a fifth embodiment of the frame unit of a curtain wall is substantially the same as the first embodiment of the frame unit. The connection between the mullions 10E, the beams 20E and the connecting devices 30E of the fifth embodiment is the same as the connection between the mullions 10, the beams 20 and the connecting devices 30 of the first embodiment.

A beam cover 50E is connected with a side of each beam 20E that faces the exterior O of the curtain wall. The connection between the beam covers 50E and the beams 20E of the fifth embodiment is the same as that of the second embodiment of the frame units. A glass support 53E is mounted on and protrudes out from a side of each beam cover 50E that is opposite to a corresponding beam 20E. A plate of glass G is mounted between two adjacent glass supports 53E by silicone adhesives. Accordingly, the mullions 10E and the beams 20E, instead of the plates of glass G, are invisible from the exterior O of the curtain wall.

From the above description, it is noted that the present invention has the following advantages:

1. Enhanced Structural Strength:

One beam 20,20A,20B,20C,20E can be assembled with multiple mullions 10,10A,10B,10C,10E by multiple connecting devices 30,30E. Because one single beam 20,20A, 20B,20C,20E is connected with and quickly spreads forces to multiple mullions 10,10A,10B,10C,10E, the curtain wall can bear strong wind loads. Preferably, ends of any longitudinally adjacent two of the beams 20,20A,20B,20C,20E are misaligned from each other to further enhance the structural strength of the curtain wall.

2. Convenient Assembling:

Because the chunks 312,322 are easily put in the mullion channels 12 and the beam channels 22,22C and because the plates 312,321 are easily put in the mullion recesses 11 and the beam recesses 22,22C, assembling of the frame units in accordance with the present invention is quick and convenient.

3. Excellent Diversification:

With the sticks 70C,70D in different shapes, the format of the assembled curtain wall is diversified and can be changed in the light of various circumstances.

4. Applicability to Different Beam Covers 50A,50B,50C, 50E and Mullion Covers 60B:

With the arrangements of the clamping sections 211,211A of the beams 20,20A,20B,20C,20E and the mullions 10,10A, 10B,10C,10E, the clipping sections 51A,51C can be connected with the clamping sections 211,211A even if the beam covers 50A,50B,50C,50E and the mullion covers 60B have different appearances.

5. Easy Production:

The mullion can be manufactured to be identical to the beam. The identical mullions and the beams can be also assembled by the connecting devices. When the structures of the mullions and the beams are the same, the production of the frame unit in accordance with the present invention is very quick and easy.

6. Reduced Costs for Material and Manufacture of the Mullions 10,10A,10B,10C,10E:

Because the structural strength of the curtain wall assembled by the frame units in accordance with the present invention is enhanced, the thickness and width of each mullion 10,10A,10B,10C,10E do not need to be enlarged and the costs for material and manufacture of the mullions 10,10A, 10B,10C,10E can be effectively reduced.

What is claimed is:

1. A frame unit of a curtain wall comprising:

a mullion being a longitudinal elongated member and having a top surface;

a bottom surface;

a side surface;

a linear mullion recess formed in the side surface of the mullion, formed through the top surface and the bottom surface of the mullion and having a bottom and an extending length; and a linear mullion channel formed in the bottom of the mullion recess and having an extending length the same as that of the mullion recess;

a beam being a latitudinal elongated member, abutting the mullion and having two opposite end surfaces;

a side surface;

a linear beam recess formed in the side surface of the beam, formed through the end surfaces of the beam and having a bottom and an extending length, wherein the side surface of the beam having the beam recess abuts the side surface of the mullion having the mullion recess; and a linear beam channel formed in the bottom of the beam recess and having an extending length the same as that of the beam recess; and a connecting device securely connected with the mullion and the beam and having a first group connected with the mullion and having a plate mounted in the mullion recess;

two chunks mounted in the mullion channel; and two bolts mounted through the plate and respectively screwed into the chunks; and a second group the same as the first group, mounted in the beam recess and the beam channel and having a plate, two chunks and two bolts, wherein the plate of the second group is connected securely with the plate of the first group.

2. The frame unit of a curtain wall as claimed in claim 1, wherein the bottom of the beam recess has a width;

the beam recess has an opening having a width larger than that of the bottom of the beam recess;

an upper edge; and a lower edge opposite to the upper edge of the opening of the beam recess;

two opposite inner surfaces, each inner surface of the beam leaning from the bottom of the beam recess to the opening of the beam recess; and two clamping sections respectively formed along the upper edge and the lower edge of the opening of the beam recess, each of the clamping sections extending latitudinally and having an inner surface and an extending length the same as that of the beam recess; and the frame unit of a curtain wall further has a beam cover having a side surface; and two clipping sections formed on the side surface of the beam cover and respectively abutting the inner surfaces of the clamping sections.

3. The frame unit of a curtain wall as claimed in claim 2, wherein the beam has a top surface;

a bottom surface; and two glass recesses respectively formed in the top surface and the bottom surface of the beam, each of the glass recesses extending latitudinally and having an extending length the same as that of the beam recess.

4. The frame unit of a curtain wall as claimed in claim 3, wherein the bottom of the mullion recess has a width;

the mullion recess has an opening having a width larger than that of the bottom of the mullion recess; and two opposite edges;

two opposite inner surfaces, each inner surface of the mullion leaning from the bottom of the mullion recess to the opening of the mullion recess; and two clamping sections respectively formed along the edges of the opening of the mullion recess, each of the clamping sections extending latitudinally and having an inner surface and an extending length the same as that of the mullion recess; and the frame unit of a curtain wall further has a mullion cover having a side surface; and two clipping sections formed on the side surface of the mullion cover and respectively abutting the inner surfaces of the clamping sections.

5. The frame unit of a curtain wall as claimed in claim 4, wherein the beam is hollow and has an inner space having a top;

a bottom; and two stick recesses formed through the end surfaces of the beam and formed respectively in the top and the bottom of the inner space of the beam except the beam recess and the beam channel;

the beam cover is hollow and has an inner space having a top;

a bottom; and two stick recesses formed through the end surfaces of the beam cover and formed respectively in the top and the bottom of the inner space of the beam cover except the clipping sections; and the frame unit of a curtain wall has multiple sticks respectively inserted into the stick recesses.

6. The frame unit of a curtain wall as claimed in claim 5, wherein the frame unit of a curtain wall has multiple glass pads respectively mounted in the glass recesses.

7. The frame unit of a curtain wall as claimed in claim 6, wherein each stick is linear.

8. The frame unit of a curtain wall as claimed in claim 6, wherein each stick is L-shaped.

9. The frame unit of a curtain wall as claimed in claim 1, wherein the plates of the first group and the second group are formed as a cross.

10. The frame unit of a curtain wall as claimed in claim 4, wherein the beam has a structure identical to that of the mullion.

* * * * *